US008597490B2

(12) United States Patent
Oliveira et al.

(10) Patent No.: US 8,597,490 B2
(45) Date of Patent: Dec. 3, 2013

(54) METHOD OF MANUFACTURING A GAS ELECTRON MULTIPLIER

(75) Inventors: Rui De Oliveira, Arenthon (FR); Serge Duarte Pinto, Geneva (CH)

(73) Assignee: CERN—European Organization for Nuclear Research, Geneva (CH)

( * ) Notice: Subject to any disclaimer, the term of this patent is extended or adjusted under 35 U.S.C. 154(b) by 308 days.

(21) Appl. No.: 12/937,755

(22) PCT Filed: Apr. 14, 2008

(86) PCT No.: PCT/EP2008/002944

§ 371 (c)(1), (2), (4) Date: Dec. 29, 2010

(87) PCT Pub. No.: WO2009/127220

PCT Pub. Date: Oct. 22, 2009

(65) Prior Publication Data

US 2011/0089042 A1 Apr. 21, 2011

(51) Int. Cl.

| | |
|---|---|
| ***C25F 3/00*** | (2006.01) |
| ***C25F 3/02*** | (2006.01) |
| ***C25F 3/04*** | (2006.01) |

(52) U.S. Cl.

USPC ..... 205/660

(58) Field of Classification Search

None

See application file for complete search history.

(56) References Cited

U.S. PATENT DOCUMENTS 5,455,459 A * 10/1995 Fillion et al. ..... 257/760
6,468,438 B1 * 10/2002 Shin et al. ..... 216/84

(Continued)

FOREIGN PATENT DOCUMENTS

| | | |
|---|---|---|
| EP | 0936660 | 8/1999 |
| GB | 1401969 | 8/1975 |
| WO | WO 2006/115249 | 11/2006 |

OTHER PUBLICATIONS

Benlloch et al., Development of the Gas Electron Multipiler, IEEE Transactions on Nuclear Science, vol. 45, No. 3, Jun. 1998, 234-243.*

(Continued)

*Primary Examiner* — Luan Van
*Assistant Examiner* — Ho-Sung Chung
(74) *Attorney, Agent, or Firm* — Sunstein Kann Murphy & Timbers LLP

(57) ABSTRACT

Methods for manufacturing a gas electron multiplier. One method comprises a step of preparing a blank sheet comprised of an insulating sheet with first and second metal layers on its surface, a first metal layer hole forming step in which the first metal layer is patterned by means of photolithography, such as to form holes through the first metal layer, an insulating sheet hole forming step, in which the holes formed in the first metal layer are extended through the insulating layer by etching from the first surface side only, and a second metal layer hole forming step, in which the holes are extended through the second metal layer. Alternatively, the second metal layer hole forming step is performed by electrochemical etching, such that the first metal layer remains unaffected during etching of the second metal layer. In another embodiment, in the second metal layer hole forming step, the first and second metal layers are etched from the outside, thereby reducing the initial thicknesses of the first and second metal layers and the second metal layer is simultaneously etched through the holes in the first metal layer and the insulating sheet, said etching being maintained until the holes extend through the second metal layer, wherein said initial average thickness of the first and second metal layers is between 6.5 μm and 25 μm, preferably between 7.5 μm and 12 μm.

24 Claims, 4 Drawing Sheets

(56) References Cited

U.S. PATENT DOCUMENTS

| | | | | |
|---|---|---|---|---|
| 2004/0011666 | A1* | 1/2004 | Taylor et al. | 205/646 |
| 2005/0158574 | A1* | 7/2005 | Suzuki et al. | 428/618 |
| 2006/0102384 | A1* | 5/2006 | Watanabe et al. | 174/256 |

OTHER PUBLICATIONS da Silva et al., An Innovative "ChemicalVia" Process for the Prodection of High Density Interconnect Printed Circuit Boards, Circuit World 30/4 (2004), 27-33.*

Altunbas, et al., "*Construction, test and commissioning of the triple-gem tracking detector for compass*", Nucl. Instrum. Methods, vol. 490, pp. 177-203, 2002.

European Patent Office; Authorized Officer: Stephane Lachaud, *Notification of Transmittal of The International Search Report of the International Searching Authority, or the Declaration and International Search Report*, International Application No. PCT/EP2008/002944, mailed Dec. 16, 2008, 15 pages.

* cited by examiner

METHOD OF MANUFACTURING A GAS ELECTRON MULTIPLIER

The present application is a US national stage application filed, under 35 U.S.C. §371, on the basis of International Application PCT/EP2008/0002944, filed Apr. 14, 2008, which is incorporated herein by reference.

BACKGROUND OF THE INVENTION

The present invention relates to a method for manufacturing a gas electron multiplier (GEM). The structure and the operation of a GEM are described in EP 0 948 803 B1, in which also a number of further references are given. FIG. 1 is a schematic diagram taken from EP 0 948 803 B1 showing the general structure and function of a GEM. In FIG. 1, a GEM 10 is located between a drift electrode DE and a collecting electrode CE. The GEM 10 consists of an insulator sheet 12 which is cladded with first and second metal layers 14, 16. In the GEM 10, a plurality of throughholes 18 are formed. The throughholes 18 typically have a diameter of 20 to 100 μm. The holes 18 are arranged in a matrix or array pattern with a pitch of typically 50 to 300 μm. A schematic view of the matrix of holes 18 is shown in FIG. 3, which has been taken from EP 0 948 803 B1 as well. The thickness of the insulating sheet 12 could be about 50 μm and the thickness of the first and second metal cladding layers 14 and 16 are typically about 5 μm thick.

Briefly, the function of GEM 10 of FIG. 1 is summarized as follows. A voltage is applied between the drift electrode DE and the collecting electrode CE. In addition, a voltage is applied between the first and second metal layers 14, 16 such that each of the holes 18 behaves like an electric dipole. The electric dipole is represented by an electric field vector $\vec{E}'$, which is superposed with the electric field $\vec{E}$ between the drift electrode DE and GEM 10 and the electric field $\vec{E}''$ between the GEM 10 and the collecting electrode CE. The superposition of the three mentioned field components leads to the electrical field line structure schematically indicated in FIG. 1. As can be seen from FIG. 1, the holes 18 lead to a local condensation of the electrical field, or in other words a local electric field amplitude enhancement. The space between the drift electrode DE and the collecting electrode CE is filled with a gas. If a primary electron is generated somewhere between the drift electrode DE and the GEM 10, the electron drifts toward the GEM due to the electric field $\vec{E}$. In the hole 18, the electric field amplitude is locally enhanced such that an electron avalanche is formed from this primary electron, where the second metal layer 16 acts as a terminal interface for the electron avalanche. The formation of the electron avalanche from a primary electron is what makes GEM an "electron multiplier". The electron avalanche is then attracted to the collecting electrode CE by the electric field, where it can be detected as a largely enhanced signal.

While FIGS. 1 and 3 only show a very small fraction of GEM 10, FIG. 2, which is also taken from EP 0 948 803 B1, shows a schematic view of the overall device. As can be seen from FIG. 2, the GEM 10 generally consists of an active area 20 in which the metal layers 14, 16 and the plurality of holes are formed. This active area 20 is surrounded by a frame 22, which is not metal-coated, but typically only consists of the insulating sheet 12. On frame 22, first and second electrodes 24 and 26 are formed on opposite sides thereof, which allow to apply the desired electrical potential to the first and second metal layers 14 and 16.

EP 0 948 803 B1 also discloses a method for manufacturing the GEM 10. According to said prior art method, two identical films or masks are imprinted with a desired pattern of holes and overlaid on each side of the metal cladded blank GEM which is previously coated with a light-sensitive resin. After exposure with ultraviolet light and development of the resin, the resin exposes only the portions of the metal layers 14, 16 corresponding to the holes to be formed. Then, the metal layers are etched simultaneously from both sides, such that holes are grown from both sides which meet in the middle to form the throughholes 18.

The prior art manufacturing method relies on the co-registering of the films or masks used for exposing the light-sensitive resin. A good coincidence of the patterns on both sides of the blank GEM can in fact be obtained if the active area 20, i.e. the area where the holes 18 are to be formed, is not too large, say 10×10 cm. However, recently there has been a demand for larger sized GEMs. When trying to manufacture bigger GEMs, the inventor found that difficulties arise with the prior art manufacturing method. In particular, for larger GEMs it turns out to be very difficult to ensure a proper co-registering of the patterns on both sides of the blank. As mentioned above, conventionally, a photomask had been directly placed on top of each of the first and second metal layers 14, 16 which were covered with a photoresist. While it is possible to print these masks with sufficient precision, it turned out that the film on which the masks were printed were not stable enough to guarantee a precise alignment of the pattern on both sides of the blank if the films are becoming larger such as to form a larger GEM. In particular, the films tend to slightly deform due to temperature and/or humidity, and given the very small size of the holes to be formed, this distortion is already enough to severely disturb the co-registering of the two patterns, which then leads to holes in which the center axes of the two halves formed from opposite sides are shifted by an unacceptable amount of 15 μm or more.

The inventor have also made attempts to circumvent these problems by using a mask material that is more stable. For example, attempts have been made to make such masks from glass. However, the results were not satisfactory. In particular, for the desired large mask sizes, the lack of planarity of the glass turned out to be a problem.

It is an object of the present invention to provide a method for manufacturing a GEM 10 that allows to manufacture high quality GEMs even at large sizes.

BRIEF SUMMARY OF EMBODIMENTS OF THE INVENTION

This problem is solved by a method according to claim 1. An alternative solution to this problem is provided by the method of claim 5. Preferred embodiments are defined in the dependent claims.

According to the first aspect of the invention, the method comprises the following steps: preparing a blank sheet comprised of an insulating sheet provided with first and second metal layers on its first and second surfaces, respectively, said first and second metal layers having an initial thickness, a first metal layer hole forming step in which the first metal layer is patterned by means of photolithography, such as to form holes through said first metal layer, an insulating sheet hole forming step in which the holes formed in the first metal layer are extended through the insulating layer by etching from the first surface side only, and a second metal layer hole forming step in which the holes formed in the first metal layer and the insulating sheet are extended through the second metal layer, said second metal layer hole forming step comprising an electrochemical etching process in which a voltage is applied between the second metal layer and an electrode immersed in the etchant, said voltage being chosen such that the second metal layer is etched.

In contrast to the method described in EP 0 948 803 B1, in the method of the invention only one of the metal layers, called the first metal layer in the following, is patterned. In other words, there is no need to co-register patterns on both sides of the blank. From this pattern in the first metal layer, the hole is grown through the insulating sheet and through the second metal layer in the consecutive steps.

The difficult part of this method is the second metal layer hole forming step. In this step, the holes have to be etched through the second metal layer, which means that a part of the etching has to be done through the holes already formed through the first metal layer and the insulating sheet. However, in this second metal layer etching step, there is the problem that in principle, when the second metal layer is etched, the first metal layer will also be exposed to the etchant and be etched as well. In practice, it turns out that the first metal layer is easily damaged by this etching step (in particular, it may happen that the metal is completely removed from the first surface of the insulating sheet at some places). This will particularly happen with large blanks, since it is very difficult to provide an absolutely uniform metal layer on a large surface of say 0.5 $m^2$ or even 1 $m^2$. Even if the insulating sheet should not be completely removed in the areas between the holes, there is still a problem that if the first metal layer is etched during the second metal layer hole forming step, the first metal layer will be etched in a region surrounding the holes, such that a small ring of insulating sheet material will be exposed on the first metal layer side. It has been found that these rings of exposed insulating sheet material will have an adverse effect on the function of the GEM, which apparently is due to ions being caught on that exposed surface.

According to the first aspect of the invention, however, the undesired etching of the first metal layer during the second metal layer hole forming step can be avoided by using an electrochemical etching step. In electrochemical etching, the etchant is not capable of etching the material through a chemical reaction, unless a suitable electric voltage is applied. By applying an electric voltage to the etchant between the material to be etched and an additional electrode immersed in the etchant, an electrolytic process is started, in which an electric current flows in the etchant and ions in the etchant react in an etching manner with the material. According to this aspect of the invention, the respective voltage is applied between the second metal layer and the immersed electrode only, such that only the second metal layer is etched, while the first metal layer remains practically unaffected. This allows to perform the second metal layer hole forming step selectively for the second metal layer without damaging the first metal layer.

In a preferred embodiment, the potential is chosen such that the second metal layer forms an anode and the electrode immersed in the etchant forms a cathode. The electrode is preferably spaced from the second metal layer by 3 to 8 cm.

In a preferred embodiment, the etchant used in the second metal layer hole forming step comprises sulfuric acid, hydrochloric acid and copper sulfate.

Preferably, during at least a portion of the second metal layer hole forming step, the electrode is provided on the first metal layer side of the blank sheet, such as to etch the second metal layer "from inside", i.e. through the holes formed at the first metal layer and the insulating sheet. Moreover, the electrode may also be provided on the second metal layer side of the blank sheet during a further portion of the second metal layer hole forming step, such as to etch the second metal layer from the outside, that is from the side to which the second metal layer is closer. The step of electrochemical etching with the electrode provided on the second metal layer side of the blank sheet is maintained at least until the holes, which have previously been formed in the second metal sheet by etching from the inside, i.e. through the holes, extend through the second metal layer. This etching can, however, be maintained until a desired thickness of the second metal layer is obtained.

Preferably, the electrochemical etching of the second metal layer from the inside, i.e. through the holes formed in the first metal layer and the insulating sheet, is maintained until said holes are extended into the second metal layer to an average depth that is at least 2 μm deeper than the final thickness of the second metal layer. Then, when the second metal layer is etched from the outside, the holes in the second metal layer will be uncovered, and the edges of the holes will have a consistent quality.

In a preferred embodiment, the initial thickness of the second metal layer exceeds the initial thickness of the first metal layer by 5 to 15 μm, preferably by 8 to 12 μm. This extra thickness can be used to first etch the holes in the second metal layer from the inside to a depth that exceeds the final thickness of the second metal layer. Then, the extra initial thickness of the second metal layer can be removed by etching from the outside, thus uncovering the holes in the second metal layer. Preferably, the final thicknesses of the first and second metal layers differ by less than 2 μm, leading to a symmetric structure which is believed to lead to a better performance of the device. The average final thickness of the first and second metal layers is preferably between 4 μm and 7 μm.

As mentioned before, in a preferred embodiment, the initial thickness of the second metal layer is larger than the initial thickness of the first layer. However, prefabricated blank sheets with different thicknesses of cladding layers may be difficult to obtain commercially. Accordingly, in a preferred embodiment, the aforementioned step of preparing a blank sheet comprises a step of adding to the thickness of the second metal layer by an electrolytic process.

According to a second aspect of the present invention, the inventor found that the second metal layer hole forming step can also be performed by ordinary chemical etching, i.e. without electrochemical etching, provided that the initial thicknesses of the first and second metal layers are appropriately chosen. According to this alternative method, the first and second metal layers are etched from the outside, thereby reducing the initial thickness of the first and second metal layers, and simultaneously the second metal layer is etched from the inside, i.e. through the holes in the first metal layer and the insulating sheet. In this second metal layer hole forming step, the etching is maintained until the holes extend through the second metal layer.

The inventor have discovered that if the initial average thickness of the first and second metal layers is between 6.5 and 25 μm, preferably between 7.5 and 12 μm, a high quality GEM even at very large sizes can be obtained.

The lower boundary of 6.5 μm, preferably 7.5 μm for the first and second metal layers is to guarantee a good yield in the manufacturing process. Below this low boundary, there is a risk that by the time all of the holes extend through the second metal layer, at some places too much if not all of the metal may unintentionally be etched away, which would compromise the function of the final GEM.

On the other hand, the upper boundary of 25 μm, preferably 12 μm will ensure that the second metal layer hole forming step will not take too long, such that the rings of exposed insulating sheet around the holes on the first metal layer side do not exceed an acceptable width, where the "acceptable width" is determined by the function of the final device. According to observations of the inventor, the width of such an exposed ring should not exceed 25 μm, preferably not exceed 15 μm. However, by appropriately choosing the initial thicknesses and the corresponding etching step as will be shown in a specific example below, an acceptable ring-like structure of say 8 μm can be obtained without the need of electrochemical etching.

In the second metal layer hole forming step of the second aspect of the invention, the blank is preferably etched in a bath containing ammonium persulfate. The bath is preferably kept at a temperature of 20° C. to 30° C., preferably 23° C. to 27° C.

The following preferred embodiments relate to both of the above manufacturing methods.

Preferably, the first and second metal layers are made from copper. The insulating sheet is preferably made from a polymer material, such as polyimide. In a preferred embodiment, a thin chromium layer is provided between the copper layer and the insulating layer to improve the adhesion of the copper on top of the polyimide.

The photolithographic first metal layer hole forming step preferably comprises the steps of providing a photoresist on both metal layers, placing a mask on top of the first metal layer defining the location of the holes to be formed, exposing and developing the photoresist on both sides of the blank such that the whole second metal layer is covered by the photoresist and the first metal layer is covered by the photoresist except for the places where the holes are to be formed, and etching the holes in the first metal layer. Preferably, the first metal layer is etched using iron perchloride at 30° C. to 40° C.

In a preferred embodiment, the insulating sheet hole forming step is performed such that the diameter of the end of the hole adjacent to the first metal layer differs from the diameter of the hole at the end adjacent to the second metal layer by less than 20%, preferably by less than 15%. Some examples how to ensure this acceptable variation of hole diameter will be given below.

The insulating sheet hole forming step preferably comprises dipping the blank sheet in a bath comprising 55% to 65% diamine ethylene and 35% to 45% water, and in addition 5 to 10 g/l KOH. The temperature is preferably 60° C. to 80° C., and more preferably 65° C. to 75° C.

In the insulating layer hole forming process, the etchant may be stirred by generating bubbles therein, such as nitrogen bubbles. This stirring leads to a more cylindrical shape of the holes rather than a conical shape.

Preferably, there is an additional step of forming electrodes for connecting the first and second metal layers by means of photolithography. In this additional photolithography step, a frame similar to frame 22 of FIG. 2 and electrodes similar to electrodes 24 and 26 of FIG. 2 are formed.

DETAILED DESCRIPTION OF PREFERRED EMBODIMENTS

Figure 1:
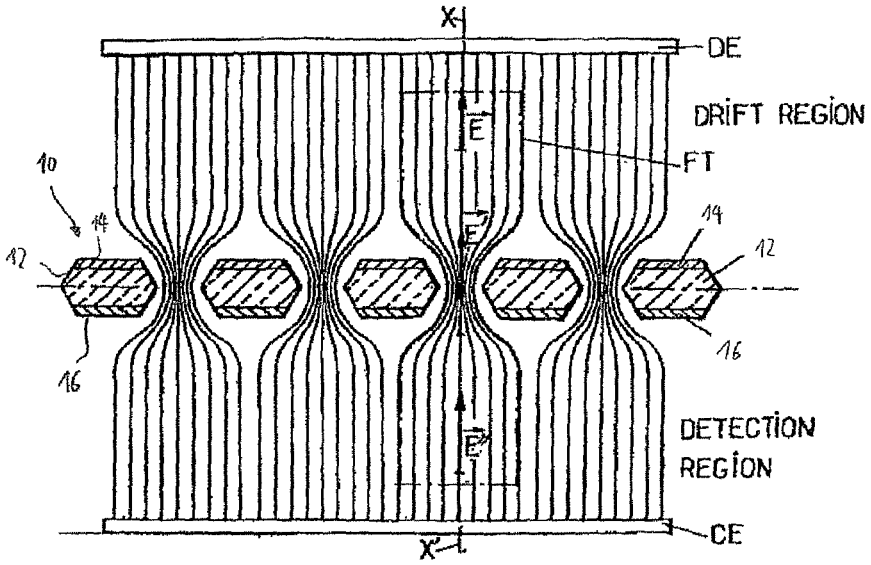
FIG. 1 is a schematic cross-sectional view of a prior art GEM placed between a drift electrode and a collecting electrode.

For the purposes of promoting and understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated method and such further applications of the principles of the invention as illustrated therein being contemplated as would normally occur now and in the future to one skilled in the art to which the invention relates.

In the following description of the figures, similar or corresponding parts of different figures have been denoted with identical reference signs.

Figure 4:
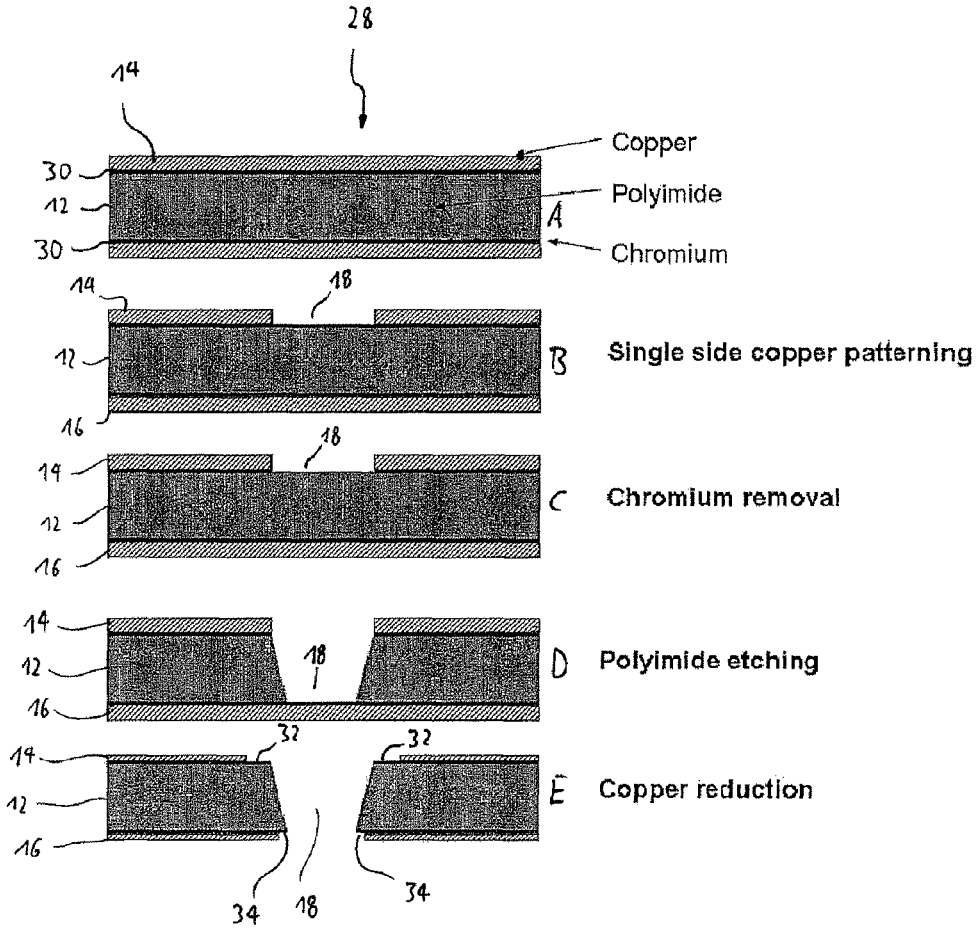
FIG. 4 is a series of cross-sectional views of a blank sheet in different stages of the manufacturing of a GEM according to a first embodiment of the invention.

With reference to FIG. 4, panel A shows the cross-section of a blank sheet 28 which is used for forming a GEM 10. The blank sheet 28 consists of a polyimide sheet 12 having a thickness of approximately 15 μm. On top of a first surface of the polyimide sheet 12, the upper surface as shown in FIG. 4, a thin film of chromium 30 and a first copper layer 14 are disposed. The chromium layer 30 is only about 0.1 μm thick and serves to promote adhesion of the first copper layer 14 on the polyimide sheet 12. The thickness of the first copper layer 14 of blank sheet 28, also called "initial thickness" in the following, is critical for the outcome of the final GEM. The initial thickness of the first copper layer 14 is between 6.5 and 25 μm, preferably it is between 7.5 and 12 μm. On the second surface of the polyimide sheet 30, an additional chromium layer 30 and a second copper layer 16 are formed, wherein the second copper layer 16 has the same thickness as the first copper layer 14. In the preferred embodiment, the total blank sheet may have a size of 0.25 $m^2$ or even 1 $m^2$.

1.1. First Metal Layer Hole Forming Step

In a first metal layer hole forming step, the first copper layer 14 and the underlying chromium film 30 are patterned to form an upper portion of the holes 18 to be formed through the GEM. In this first metal layer hole forming step, the first and second copper layers 14, 16 are laminated with a thin photoresist (KL1015). Next, a masking film is placed on top of the first copper layer 14, on which the pattern of the holes 18 to be formed is printed. No mask is provided on top of the second copper layer 16. Next, the blank sheet 28 is exposed by intense light from both sides. The exposure is performed in a machine DUPONT PC 130. The photoresist used is a negative photoresist, which becomes chemically more stable upon exposure. Then, the photoresist is developed by means of a $Na_2CO_3$ spray in a RESCO machine at a speed of 0.7 m/min at 35° C. During this developing, the resist is removed at the locations where the holes 18 are to be formed. The diameter of the holes in the photoresist are checked. In the present embodiment, the diameters shall be 55 μm+/−2 μm.

Next, the first copper layer 14 is etched in a conveyer machine at 35° C., such that holes 18 are formed through the first copper layer 14. For the etchant, iron perchloride is used at a temperature of 35° C. After etching, the holes in the first copper layer 14 are checked to have a size of 60 μm+/−2 μm. This part of the process with a hole in the first copper layer 14 is shown in panel B of FIG. 4. Note that the second copper layer 16 has not been etched, since it is covered completely with photoresist.

Next, the photoresist is stripped off in a bath of ethyl alcohol. Then, the thin chromium layer within hole 18 is stripped by immersing the blank sheet 28 in a bath of potassium permanganate at 60° C. for 15 seconds (see panel C of FIG. 4).

1.2. Insulating Sheet Hole Forming Step

Next, in an insulating sheet hole forming step, the hole 18 formed in the first copper layer 14 is extended vertically through the polyimide layer 12. This is done by etching in a bath containing 60% of diamine ethylene, 40% of water and in addition, 7 g/l KOH. The temperature of the bath is 70° C.

As is seen in panel D of FIG. 4, the holes 18 etched through the polyimide sheet 12 will have a slightly conical shape tapering towards the second metal layer 16. In fact, the inventor observed that such a conical shape may lead to a particularly good behavior of the final GEM 10. However, the diameter of the hole 18 within the polyimide layer 12 at the end adjacent to the first copper layer 14 should not differ from the diameter of the hole at the end adjacent to the second copper layer 16 by more than 20%, preferably by less than 15%. In the present example, the etching of the polyimide sheet 12 is performed such that the upper and lower diameters of the hole within the polyimide sheet 12 differ by less than 10 μm. A more cylindrical shape of the hole 18 within the polyimide layer can be promoted by stirring the etchant, for example by introducing nitrogen bubbles therein.

1.3. Electrode and Frame Forming Step

Figure 2:
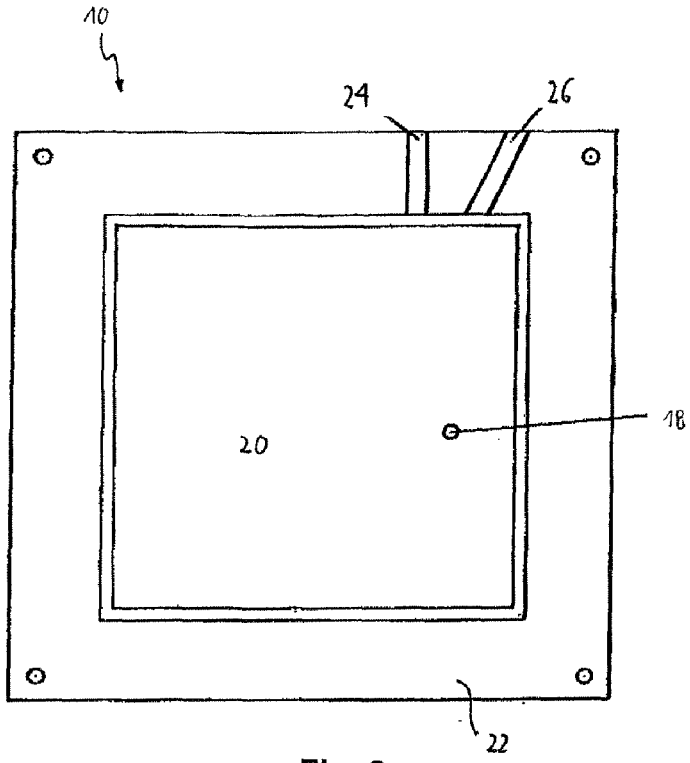
FIG. 2 is a schematic plan view of a prior art GEM.
Figure 3:
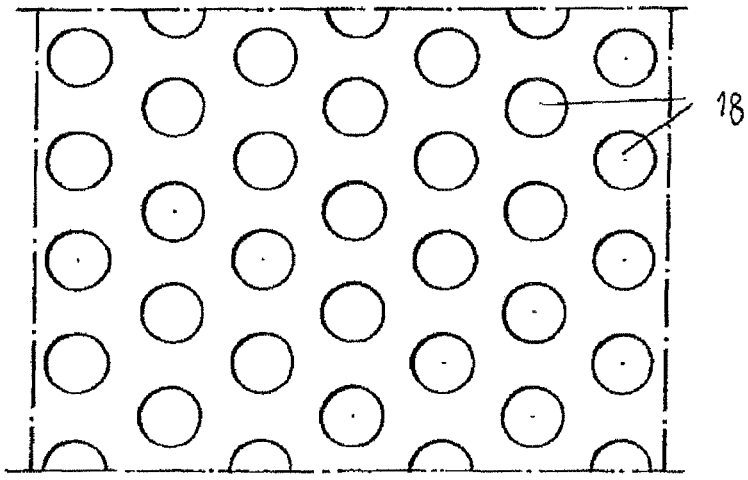
FIG. 3 is a close-up view of a small section of the active area of the GEM of FIG. 2 showing the matrix of holes.

While not shown in FIG. 4, next an additional photolithographic etching step is performed in which a frame 22 is formed around the active area 20 of GEM 10 and electrodes 24 and 26 are formed connecting the first and second copper layers 14, 16 of the active area 20 in a similar way as shown in FIG. 2. The photolithographic steps are similar to the ones described in part 1.1. above and their description is are therefore not repeated again.

1.4. Second Metal Layer Hole Forming Step

Next, the holes 18 are extended through the second copper layer 16. This etching step is performed in a bath of ammonium persulfate at a temperature of 25° C. The blank sheet 28 is kept in the bath until the holes 18 extend through the second copper layer 16. The end of this etching step can easily be determined by visual inspection: as soon as light shines through the blank sheet 18, this etching step shall be finished.

In this etching step, the first and second copper layers 14, 16 are etched from "the outside", i.e. with reference to FIG. 4, the first copper layer 14 is etched from above and the second copper layer 16 is etched from below. In addition, the second copper layer 16 is etched from "inside", i.e. from inside the hole 18. Accordingly, during this etching step, both, the first and second copper layers 14, 16 are etched, such that their thicknesses are decreased as is indicated in panel E of FIG. 4. Accordingly, the initial thickness of the first and second copper layers 14, 16 needs to be carefully chosen such that the remaining thickness thereof, at the time the hole 18 penetrates the second copper layer 16, is still sufficiently thick, such that in consideration of non-uniformity in the initial copper layers 14 and 16, the final copper layers 14 and 16 continuously cover the polyimide layer 12 in the area between the holes 18. Since the method is especially conceived for manufacturing larger GEM sizes than previously known, having an active surface of say 0.25 $m^2$ or even up to 1 $m^2$, the non-homogeneity of the initial thicknesses of the first and second copper layers 14, 16 will inevitably be limited. For this reason, the initial thickness of the first and second copper layers 14, 16 shall be at least 6.5 μm, preferably at least 7.5 μm, such that a damage of the copper layers 14, 16 in the etching of the second copper layer hole forming step is avoided.

On the other hand, the initial thicknesses of the first and second copper layers 14, 16 should not be too large either. When etching the copper layers 14, 16 to complete the hole 18 through the second copper layer 16, the first copper layer 14 will be removed from an area around the edge of each hole 18, such that a ring-like area 32 on the first surface of the polyimide sheet 12 surrounding the hole 18 is formed, which is not covered by the copper layer 14 anymore. The inventor have found out that in operation of the final GEM, the performance will be deteriorated if the exposed rings 32 are too big. The width of this exposed ring portions 32 should be 15 μm or less, preferably 10 μm or less. The larger the initial thickness of the copper layers 14, 16, the larger will the width of the exposed ring portion 32 eventually be. Accordingly, the initial thicknesses of the first and second copper layers 14, 16 shall be less than 25 μm, preferably even less than 12 μm.

With an initial copper layer thickness of 8 μm and the process parameters as summarized above, the width of the exposed ring portion 32 on the first surface of the polyimide sheet 12 was 8 μm only, which is narrow enough such as to not adversely affect the functioning of the final GEM 10. With an initial thickness of 15 μm, the widths of the exposed ring-like portions 32 were about 15 μm, which turned out to be inferior in operation of the final GEM 10, but still acceptable. Also, an additional ring-like exposed portion 34 is formed on the second surface of the polyimide sheet 12, but this ring is considerably smaller than the one on the first surface.

1.5. Cleaning and Testing

Finally, the GEM 10 with the holes 18 formed as mentioned above is cleaned in a manner known per se. However, the cleaning method according to one embodiment is chosen such that the thin chromium layer 30 covering the exposed ring-like portions 32 and 34 is not stripped off. In particular, no potassium permanganate is used in the cleaning step, as this would remove the chromium layer. When the chromium layer remains on the exposed ring-like portions 32, 34, the function of the final GEM will be better than if the insulating polyimide is directly exposed. Alternatively, the cleaning method could be chosen such that the chromium layer is removed partly or completely.

As a final step, the device is tested by applying a voltage of about 600 V between the first and second copper layers 14, 16 and measuring a current therebetween at reduced humidity of 35%. The test is passed if the current measured is below a predetermined threshold.

Second Embodiment

Figure 5:
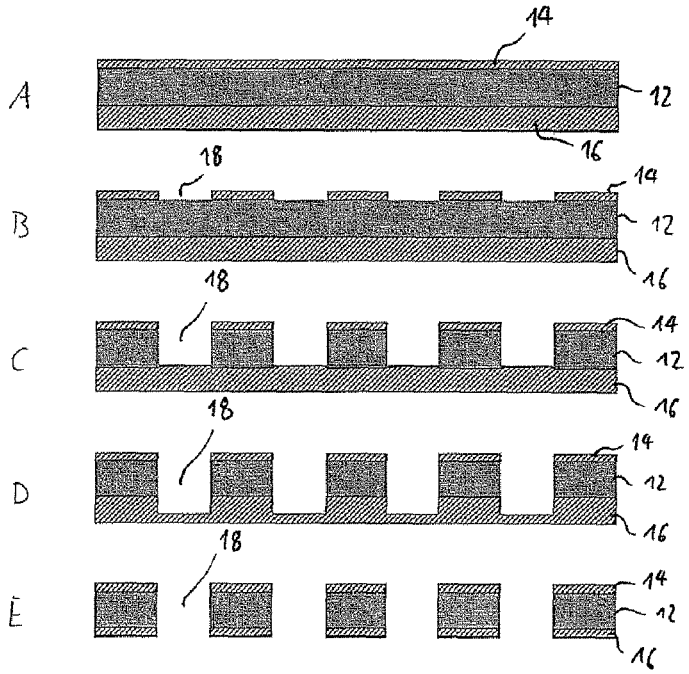
FIG. 5 is a series of cross-sectional views of a blank sheet in different stages of the manufacturing of a GEM according to a second embodiment of the invention

Next, a second embodiment of the invention is described with reference to FIG. 5. As is seen in panel A of FIG. 5, again a blank sheet 28 is prepared having a polyimide insulating layer 12 and first and second copper layers 14, 16 on top of its first and second surfaces. However, in this case, the blank 28 is prepared such that the second copper layer 16 is thicker than the first copper layer 14. In the example shown, the first copper layer 14 is 5 μm thick and the second copper layer 16 is 15 μm thick. Such a blank 28 can be prepared by electrolytically adding 10 μm of copper to the second metal layer 16 of an original blank (not shown) having 5 μm of copper cladding on each side.

The patterning of the first copper layer 14 and the underlying chromium layer is performed similarly as described in section 1.1. above and shall not be repeated here. Panel B of FIG. 5 shows the blank sheet 28 after patterning, where in contrast to FIG. 4, the formation of four holes is depicted.

The insulating sheet hole forming step is also similar to that of the first embodiment described in section 1.2. above. However, as compared to panel D of FIG. 4, the holes 18 formed in the polyimide layer 12 in this instance are more cylindrical.

This is achieved by stirring the etchant by means of nitrogen bubbles. The first and second side ends of the hole 18 through the polyimide layer 12 differs by less than 5 μm. It is to be understood that more cylindrical holes could be used in the first embodiment and more conical holes could be used in the second embodiment as well. Also, the steps of forming the electrodes 24, 26 (see FIG. 2) and the frame 22 surrounding the active area 20 are performed in a way similar to the first embodiment.

The main difference with regard to the first embodiment relates to the second metal layer hole forming step. For forming the holes through the second copper layer 16, in this embodiment, the blank sheet 28 is immersed in a bath based on sulfuric acid, hydrochloric acid and copper sulfate. In addition, an electrode (not shown) is immersed in the bath about 5 cm away from the blank sheet 28 on the side facing the first copper layer 14. A voltage is applied between the second metal layer 16 and the electrode (not shown) such that the electrode forms a cathode and the second copper layer 16 forms an anode. Due to the voltage between the second copper layer 16 (anode) and the cathode (not shown), an electrolytical process is initiated, where an electric current flows in the etchant and ions in the etchant react in etching manner with the second copper layer 16. Since in this step of the method, the cathode (not shown) is disposed such as to face the first copper layer 14, or in other words is placed above the blank sheet 28 as shown in FIG. 5, the second copper layer 16 is etched from the "inside", i.e. through the holes 18 formed in the first copper layer 14 and polyimide layer 12. This electrochemical etching step is maintained until the holes 18 extend into the second copper layer 16 to a depth of at least 7 μm. During this electrochemical etching, due to its neutral potential, the first copper layer 14 is not etched.

Next, the cathode is placed on the opposite side of the blank sheet 28 such that it is now facing the second copper layer 16 side of the blank sheet 28. The electrochemical etching is continued, this time etching the second copper layer 16 from the outside, such that its thickness is continuously decreased until it reaches about 5 μm and thus coincides with the thickness of the first copper layer 14. Since the holes had been extended into the second copper layer 16 to a depth of at least 7 μm in the previous step, the holes 18 will be exposed such that a structure as shown in panel D of FIG. 5. is obtained.

The electrochemical etching is preferably performed at room temperature and with a current density on the order of 0.5 $A/dm^2$.

Electrochemical etching allows to selectively etch the second copper layer 16 without damaging the first copper layer 14. Also, by changing the electrochemical etching direction, i.e. by switching the side on which the cathode is disposed, holes with excellent shape quality can be obtained. After this second metal layer hole forming process, the final GEM is cleaned and tested in a similar way as described above.

Although preferred exemplary embodiments are shown and specified in detail in the drawings and the preceding specification, this should be viewed as purely exemplary and not as limiting the invention. It is noted in this regard that only the preferred exemplary embodiments are shown and specified, and all variations and modifications should be protected that presently or in the future lie within the scope of protection of the invention.

LIST OF REFERENCE NUMBERS

10 GEM
12 Insulator sheet/polyimide sheet
14, 16 first and second metal layers
18 throughholes
20 active area
22 frame
24, 26 first and second electrodes
28 blank sheet
30 thin film of chromium
32 ring-like portions
34 additional ring-like portion

We claim:

1. A method of manufacturing a gas electron multiplier (GEM), said GEM comprising an insulating sheet having first and second surfaces, first and second metal layers provided on top of said first and second surface, respectively, and a plurality of throughholes extending through said insulating sheet and said first and second metal layers, said method comprising the following steps:

preparing a blank sheet comprising an insulating sheet provided with first and second metal layers on its first and second surfaces, respectively, said first and second metal layers having an initial thickness;

a first metal layer hole forming step in which the first metal layer is patterned by means of photolithography to form holes through said first metal layer, an insulating sheet hole forming step, in which the holes formed in the first metal layer are extended through the insulating layer by etching from the first surface side; and a second metal layer hole forming step, in which the holes formed in the first metal layer and the insulating sheet are extended through the second metal layer, said second metal layer hole forming step comprising an electrochemical etching process in which a voltage is applied between the second metal layer and an electrode immersed in the etchant, said voltage being chosen such that only the second metal layer is etched, while the first metal layer remains substantially unaffected.

2. The method of claim 1, wherein the potential between the electrode and the second metal layer is such that the second metal layer forms an anode and the electrode immersed in the etchant forms a cathode.

3. The method of claim 1, in which the etchant used in the electrochemical etching comprises sulfuric acid, hydrochloric acid and copper sulfate.

4. The method of claim 1, wherein during at least a portion of said second metal layer hole forming step, the electrode is provided on the first metal layer side of the blank sheet to etch the second metal layer through the holes formed in the first metal layer and the insulating sheet.

5. The method of claim 1, wherein during a portion of said second metal layer hole forming step the electrode is provided on the second metal layer side of the blank sheet to etch the second metal layer from the outside.

6. The method of claim 5, wherein the step of electrochemical etching of the second metal layer with the electrode provided on the second metal layer side of the blank sheet is maintained at least until the holes extend through said second metal layer.

7. The method of claim 5, wherein the electrochemical etching through the holes formed in the first metal layer and the insulating sheet is maintained until said holes are extended into said second metal layer to an average depth that is at least 2 μm deeper than a final thickness of the second metal layer.

8. The method of claim 1, wherein the initial thickness of the second metal layer exceeds the initial thickness of the first metal layer by 5 to 15 μm.

9. The method of claim 1, wherein final thicknesses of the first and second metal layers differ by less than 2 μm.

10. The method of claim 1, wherein average final thicknesses of the first and second metal layers are between 4 μm and 7 μm.

11. The method of claim 1, wherein said step of preparing a blank sheet comprises a step of adding to the thickness of the second metal layer by an electrolytic process.

12. A method as in claim 1, wherein the first and second metal layers are made from copper.

13. A method as in claim 1, wherein the insulating sheet is made from a polymer material.

14. A method as in claim 12 or 13, wherein a chromium layer is provided between the copper layers and the insulating sheet.

15. A method as in claim 1, wherein the photolithographic first metal layer hole forming step comprises the following steps:

providing a photoresist on both metal layers;

placing a mask on top of the first metal layer defining the location of the holes to be formed;

exposing and developing the photoresist on both sides of the blank such that the whole second metal layer is covered by the photoresist and the first metal layer is covered by the photoresist except for the places where the holes are to be formed; and etching the holes in the first metal layer.

16. A method as in claim 1, wherein the first metal layer is etched using iron perchloride at 30° C. to 35° C.

17. A method as in claim 1, wherein the insulating sheet hole forming step is performed such that the diameter of the hole within the insulating sheet at the end adjacent to the first metal layer differs from the diameter of said hole at the end adjacent to the second metal layer by less than 20.

18. A method as in claim 1, wherein the insulating sheet hole forming step comprises dipping the blank sheet in a bath comprising 55% to 65% diamine ethylene and 35% to 45% water, and in addition 5 to 10 g/1 KOH.

19. The method of claim 18, wherein the insulating sheet hole forming step is performed at a temperature of 60° C. to 80° C.

20. A method as in claim 1, wherein in the insulating sheet hole forming process, the etchant is stirred by generating bubbles therein.

21. A method as in claim 1, further comprising a step of forming electrodes by means of photolithography for connecting the first and second metal layers to a voltage source.

22. A method as in claim 14, further comprising, after said second metal layer hole forming step, a step of cleaning the GEM, said cleaning step being adapted to not remove any chromium layer present between the first and second metal layers that is exposed during said cleaning step.

23. A method as in claim 1, wherein the holes are simultaneously formed in an area larger than 0.1 $m^2$.

24. A method as in claim 1, wherein the holes have a diameter of 20 μm to 100 μm, and a pitch of 50 to 300 μm.

* * * * *

UNITED STATES PATENT AND TRADEMARK OFFICE

CERTIFICATE OF CORRECTION

PATENT NO. : 8,597,490 B2
APPLICATION NO. : 12/937755
DATED : December 3, 2013
INVENTOR(S) : Oliveira et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 385 days.

Signed and Sealed this
Twenty-second Day of September, 2015

Michelle K. Lee

Michelle K. Lee
*Director of the United States Patent and Trademark Office*